US005600080A

United States Patent [19]

Belli

[11] Patent Number: 5,600,080

[45] Date of Patent: Feb. 4, 1997

[54] DRUM SUSPENSION AND MOUNTING APPARATUS

[75] Inventor: Remo D. Belli, North Hollywood, Calif.

[73] Assignee: Remo, Inc., Valencia, Calif.

[21] Appl. No.: 499,817

[22] Filed: Jul. 10, 1995

[51] Int. Cl.[6] ..... G10D 13/02

[52] U.S. Cl. ..... 84/421

[58] Field of Search ..... 84/411 R, 421

[56] References Cited

U.S. PATENT DOCUMENTS

| | | | |
|---|---|---|---|
| 4,334,458 | 6/1982 | Grauso | 84/411 R |
| 5,337,645 | 8/1994 | Johnston | 84/421 |
| 5,477,787 | 12/1995 | May | 84/421 |

*Primary Examiner*—Cassandra C. Spyrou
*Attorney, Agent, or Firm*— Rapkin Gitlin & Moser

[57] ABSTRACT

A musical drum comprising a substantially cylindrical drum shell having a cylindrical shell wall and at least one end over which a drumhead is attached and a means having a first and second end disposed substantially and continuously around the periphery of the shell in contact relation with the shell for mounting the drum to a support device. The means for mounting the drum to a support device comprises a flexible band connected at each end to a bracket assembly for receiving a drum support means which generally comprises a rod that is inserted into the opening in the bracket assembly. The flexible band is disposed within a circumscribed recess or slot formed within the shell wall.

5 Claims, 4 Drawing Sheets

DRUM SUSPENSION AND MOUNTING APPARATUS

FIELD OF THE INVENTION

This invention relates to a new and useful improvement in certain kinds of percussion instruments, and more particularly in an apparatus employed with a musical drum for suspending and mounting the instrument to enable it to resonate more freely and sustain the drum tones.

DESCRIPTION OF THE PRIOR ART

In the prior art, suspending a drum off the ground will generally permit the drum shell and the drum head to vibrate more freely. Specifically, the tone produced by the drum when the batter head is struck is sustained over time and the range of tone is expanded beyond the normal experience of the prior art instruments. The drum's fundamental sound, i.e. the lowest note that the instrument is capable of producing, is also enhanced.

The standard drum bracket is normally mounted to the shell, where it is attached with screws or with the use of some other suitable conventional means. This mounting apparatus has been popular and in use for many years, because it is quick and easy to employ and cost effective to manufacture. Yet, the standard bracket has its drawbacks.

One of the principal drawbacks associated with this kind of bracket is the disruption it appears to cause to the vibrations generated through the instrument, particularly in the shell portion through which a substantial amount of the drum's musical resonating tones are radiated.

In attaching the bracket to a relatively small and confined area on the drumshell, the area effected becomes pinched or squeezed. This, in turn, causes a physical stress to be concentrated and localized at that point. Waves of vibrations radiating relatively evenly through the shell material will be disrupted around the area of the bracket where the stress is focused. Consequently, the pleasing resonating sounds will be distorted and the quality of the drum tones that are ultimately produced will suffer a severe degradation.

A variety of systems in the prior art are provided to address the problems associated with conventional mounting brackets. For example, U.S. Pat. No. 4,158,980 issued to Gauger discloses a bracket with an arcuate member that mounts to pre-existing drum lugs. This bracket is generally semi-circular in shape and provides its main support at diametrically opposed points on the drum.

Another type of mounting system suspends the drum by employing a clamp that locks onto the counter-hoop. The clamp acts as a mounting bracket for receiving a rod or similar object to support the drum in the proper position.

Both devices require a secure attachment either to the counter-hoop or the drum lugs, resulting in a more difficult process of removal and installation of the drumhead when the replacement of the head becomes necessary.

In testing and examining these and various other systems, it becomes increasingly clear that the improvement of the present invention over the prior art provides for a more evenly spread of the physical load of the drum suspension apparatus around the shell. This, in turn, precludes the build-up of stress concentration at any one location and the resultant disruption or interference with the pleasing resonating musical tones that radiate naturally through the shell and ultimately are produced by the instrument. Also, the present invention is not employed in conjunction with either the drum lugs or the counter-hoop. Thus, the device never interferes with the installation and removal of the drum head.

SUMMARY OF THE INVENTION

The present invention provides for a musical drum comprising a substantially cylindrical drum shell having a cylindrical shell wall and at least one end over which a drumhead is attached. Also included is a means having a first and second end disposed substantially and continuously around the periphery of the shell in contact relation with the shell for mounting the drum to a support device. The means for mounting the drum to a support device comprises a flexible band connected at each end to a bracket assembly for receiving a drum support means. The drum support means, which generally comprises a rod in one form or another, is inserted into the opening in the bracket assembly. The bracket assembly also includes a conventional means for securing the rod inside the opening. The flexible band, to ensure a fixed condition around the periphery of the shell, is disposed within a circumscribed recess or slot formed within the shell wall.

Accordingly, an object of the present invention is to provide a drum suspension and mounting apparatus for use in enabling the drum to vibrate more freely and naturally and sustain the musical tones produced by the instrument when the batter head is struck.

Another object of the present invention is to provide a drum suspension and mounting apparatus for use in enabling the drum to achieve fundamental sounds.

Still another object of the present invention is to provide a drum suspension and mounting apparatus for use in enabling the drum to expand the normal range of tones produced by the instrument when the batter head is struck.

Still yet another object of the present invention is to provide a drum suspension and mounting apparatus that enhances the drumhead and drumshell resonance to produce sustained drum sounds.

Still yet another object of the present invention is to provide a drum suspension and mounting apparatus that provides a more evenly spread of the physical load of the apparatus around the periphery of the shell for precluding the build up of stress concentration at any one point along the shell wall and the resultant distortion of the resonating tones radiating through the shell.

Yet another object of the present invention is to provide a drum suspension and mounting apparatus that enables the drumhead to be easily and quickly removed and installed when replacement of the head component is required.

Yet another object of the present invention is to provide a drum suspension and mounting apparatus that is easy and cost effective to manufacture and operate.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 3:
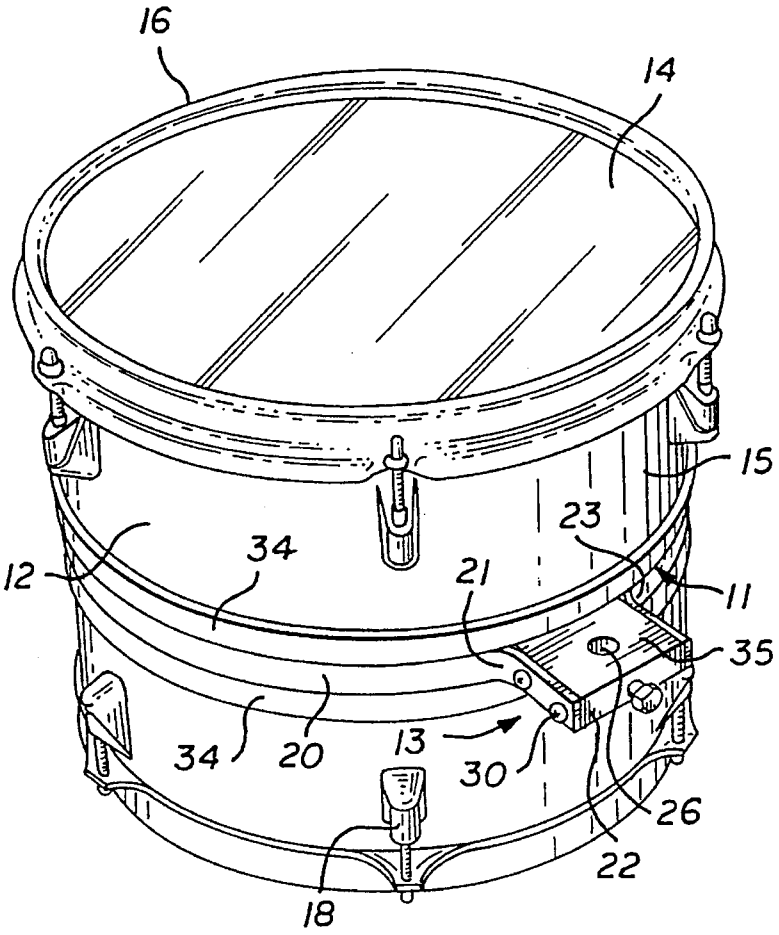
FIG. 3 is a partial perspective of the present invention shown from a different view in conjunction with a drum.
Figure 1:
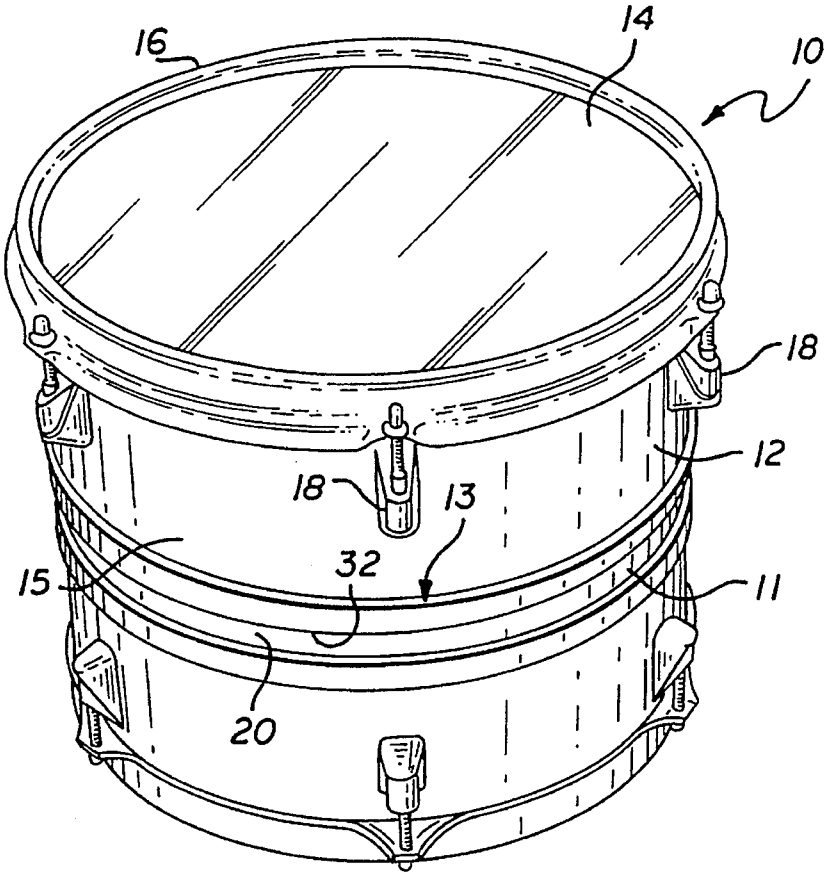
FIG. 1 is a partial perspective of the present invention shown in conjunction with a drum.
Figure 2:
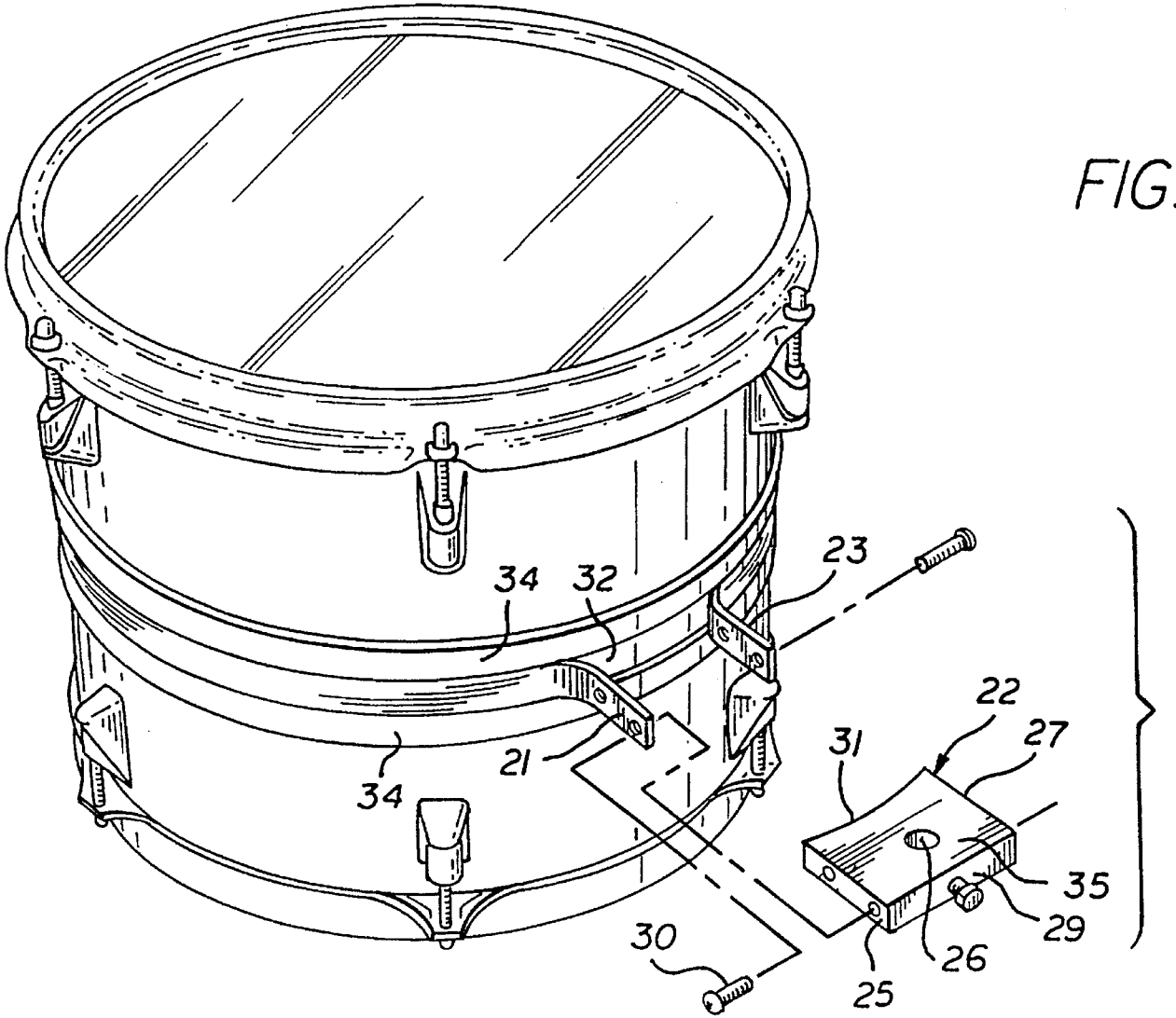
FIG. 2 is a partial perspective of the present invention with the mounting bracket portion shown in an exploded view.

Referring more particularly to the drawings, FIG. 1 is a perspective view of a conventional drum 10, which includes a batter head 14, a counter-hoop 16, a plurality of drum lugs 18 and a drum shell 12. Also shown with drum 10 is the drum suspension and mounting apparatus 11 of the present invention. Suspension and mounting apparatus 11 includes a band 20 disposed circumferentially around the approximate mid-point 13 of the outer wall 15 of the shell 12. Band ends 21, 23 are connected to the opposite sides 25, 27, respectively, of bracket 22, where they are secured using any suitable type of conventional mounting screws 30. At the approximate center 35 of the bracket 22 is an opening 26 for receiving a mounting rod 28. Adjusting screw 24 is provided to secure and tighten mounting rod 28 inside the opening 26. Alternative means may also be employed in place of bracket 22 and mounting rod 28 to achieve the intended objective of the present invention.

In order to secure the band 20 to the outer wall 15 of the shell 12 and prevent it from sliding about, a raised annular band 34 is provided along with an annular groove 32 disposed therein. Band 20 is set within the annular groove 32 and bent in an arcuate shape to coincide with the outer drum wall 15. Each of the band ends 21, 23 is then bent again to coincide as closely as possible with the length and spatial orientation of the bracket sidewalls 25, 27 to which they are respectively secured with the appropriate mounting screws 30.

Band 20 is approximately ¾" in width and 1/16" thick, though these dimensions may vary depending on the size of the drum, aesthetic considerations and other factors. Band 20 is generally fabricated of any suitable metal alloy, though it may also be made of other material compositions, such as fiberglass or other appropriate synthetic or natural substances, such as wood or woven fabric.

Figure 4:
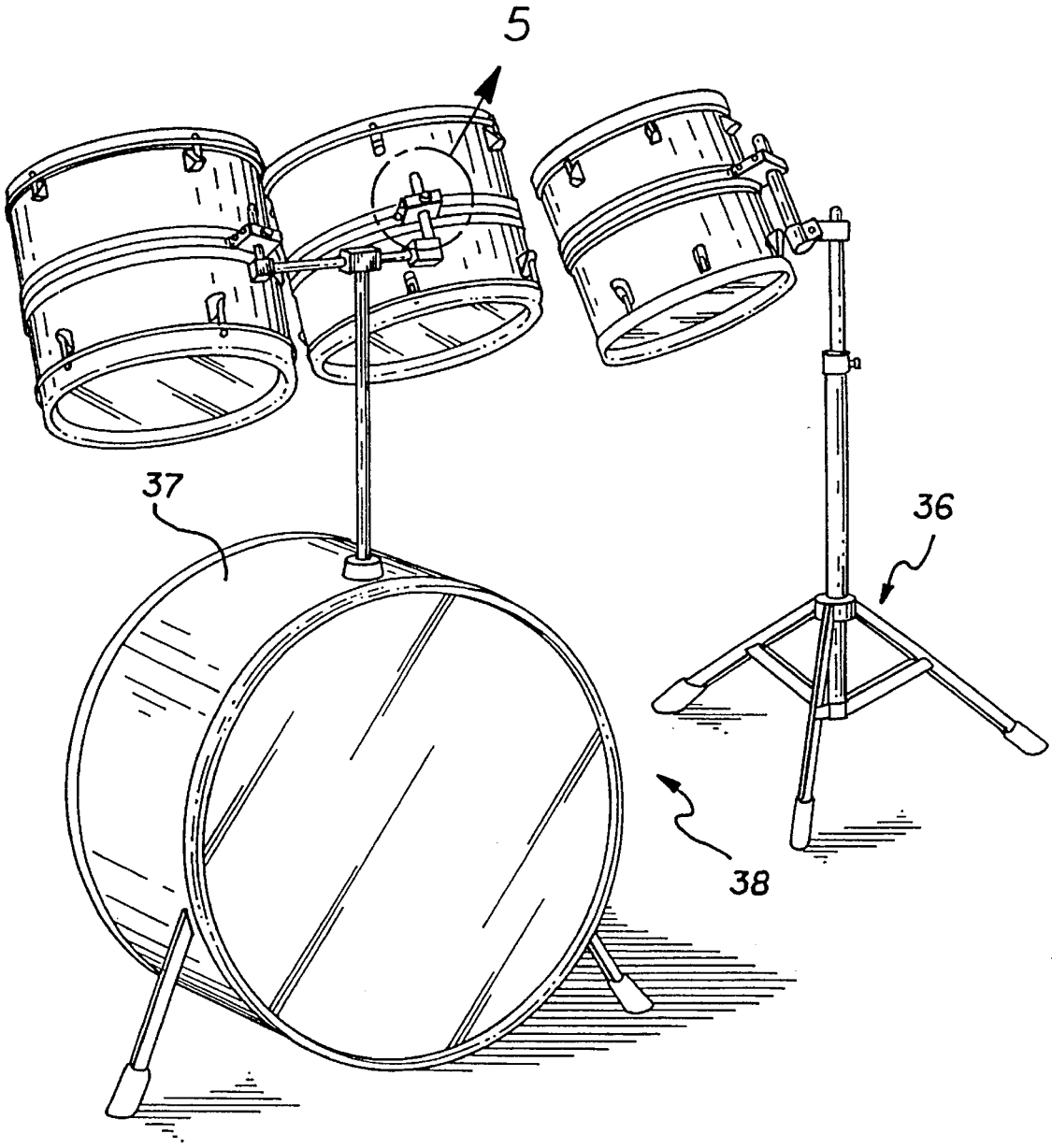
FIG. 4 is a perspective of the present invention shown in connection with components of a musical drum set.
Figure 5:
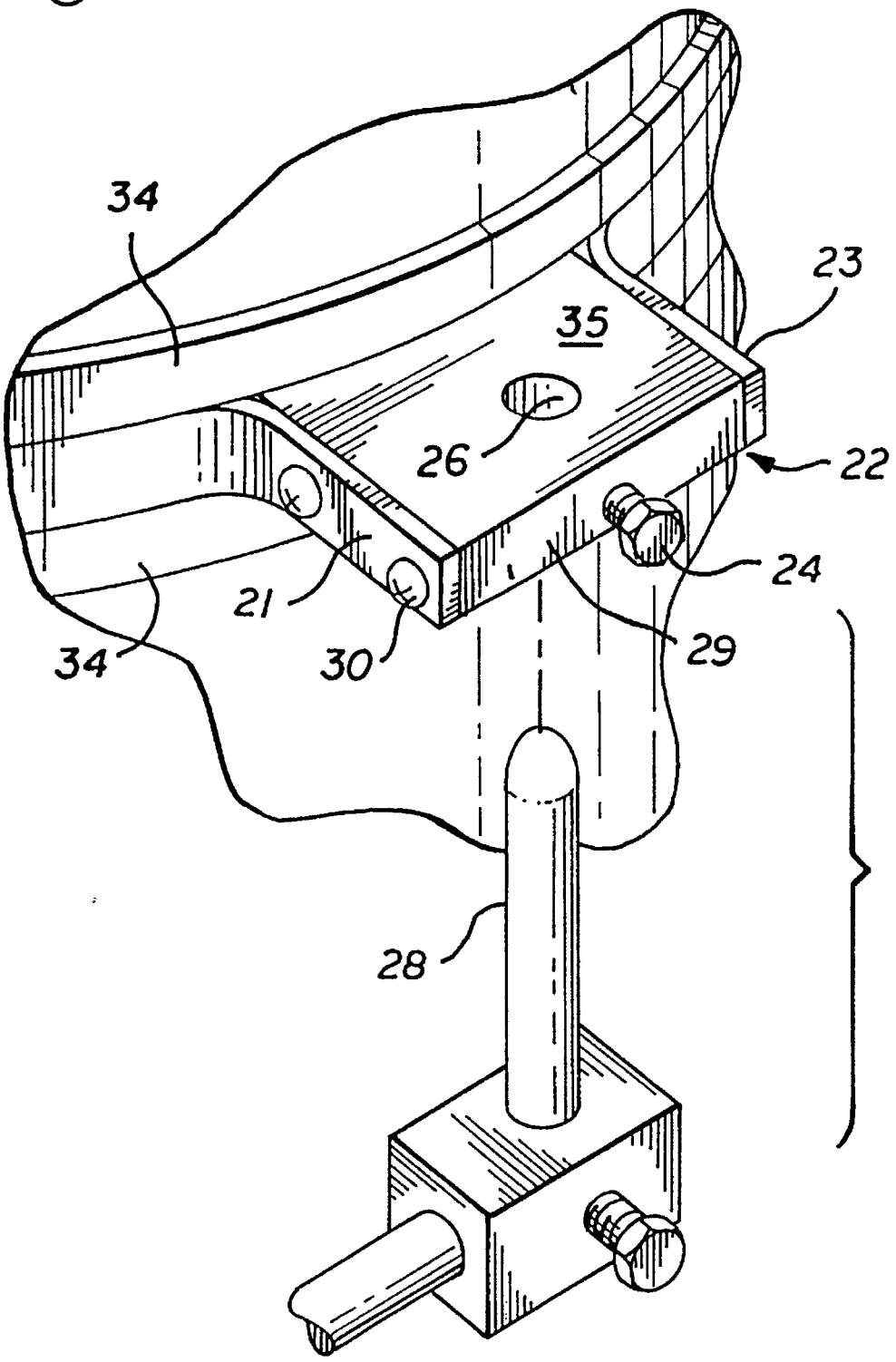
FIG. 5 is an enlarged view of the mounting bracket receiving a support rod taken along line 5—5 of FIG. 4.

As shown in FIG. 4, mounting rod 28, which is typically made of metal, can either extend from a conventional floor stand 36 or extend vertically from another kind of support apparatus, such as the top surface 37 of a base drum 38.

Bracket 22 is generally rectangular in shape and will usually conform in thickness to the width of the band 20. Bracket 22 includes three sidewalls 25, 27 and 29, which are straight and even, and a sidewall 31, which is annular to better conform to the shape of the annular groove 32, to which it abuts. Bracket 22, as with the band 20, is preferably fabricated of a metal alloy or a synthetic composition. Other materials, such as wood, may act as a substitute. The present invention can also comprise solely the band 20 without a definable bracket as long as there is provided some means to otherwise hold the drum or suspend it from above a counting apparatus.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. A musical drum comprising:

a substantially cylindrical drum shell having a cylindrical shell wall with an outer portion and at least one end over which a drumhead is to be attached, and a means for suspending said drum from a support device comprising an apparatus disposed substantially and continuously around the outer portion of the shell wall in contact relation therewith within a circumscribed slot formed within said shell wall and having a first end member and a second end member and a bracket assembly, said bracket assembly including a first side and a second side for attachment to said first end member and said second end member, respectively, whereby vibrations produced upon the striking of the drumhead are spread evenly throughout the shell to sustain musical tones and achieve fundamental sounds.

2. A drum as in claim 1 wherein said means for suspending said drum from a support device comprises a flexible band connected at said first end and said second end to said bracket assembly.

3. A drum as in claim 2 wherein said support device comprises a rod mounted upon a stand.

4. A drum as in claim 3 wherein said bracket assembly includes an opening conformed to slidably receive said rod.

5. A drum as in claim 4 wherein said bracket includes an adjusting screw for fastening said rod in said opening.

* * * * *